US007849960B2

(12) United States Patent
Nicolai et al.

(10) Patent No.: US 7,849,960 B2
(45) Date of Patent: Dec. 14, 2010

(54) SILENCER

(75) Inventors: Manfred Nicolai, Esslingen (DE); Frank Castor, Esslingen (DE); Jan Krüger, Neuhausen (DE)

(73) Assignee: J. Eberspaecher GmbH & Co., KG, Esslingen (DE)

( * ) Notice: Subject to any disclaimer, the term of this patent is extended or adjusted under 35 U.S.C. 154(b) by 0 days.

(21) Appl. No.: 12/134,761

(22) Filed: Jun. 6, 2008

(65) Prior Publication Data

US 2008/0302598 A1 Dec. 11, 2008

(30) Foreign Application Priority Data

Jun. 6, 2007 (DE) ..... 10 2007 026 811

(51) Int. Cl.
*F01N 1/02* (2006.01)
*F01N 1/04* (2006.01)
*F01N 1/00* (2006.01)

(52) U.S. Cl. ..... 181/253; 181/272; 181/275; 181/254

(58) Field of Classification Search ..... 181/253, 181/268, 269, 272, 275, 254, 249, 251, 255, 181/213, 264
See application file for complete search history.

(56) References Cited

U.S. PATENT DOCUMENTS 5,821,474 A * 10/1998 Olszok et al. ..... 181/254
5,917,161 A * 6/1999 Fuhrmann ..... 181/237
5,984,045 A 11/1999 Maeda et al.
6,173,808 B1 * 1/2001 Maeda et al. ..... 181/254
2007/0045043 A1 * 3/2007 Hoerr et al. ..... 181/250

FOREIGN PATENT DOCUMENTS

| | | | |
|---|---|---|---|
| DE | 94 05 771 | U1 * | 8/1994 |
| DE | 19540716 | | 4/1997 |
| DE | 19729666 | A1 | 1/1998 |
| DE | 19953307 | | 6/2000 |
| DE | 10331479 | A1 | 2/2005 |
| DE | 102005003582 | | 8/2006 |
| FR | 2718488 | B1 | 10/1995 |
| GB | 548710 | | 10/1942 |
| GB | 2 343 716 | A * | 5/2000 |
| JP | 2-248609 | | 10/1990 |
| JP | 05156920 | A * | 6/1993 |
| JP | 06088514 | A * | 3/1994 |
| JP | 10227208 | A | 8/1998 |

OTHER PUBLICATIONS

European Search Report dated Sep. 16, 2008.
German Search Report dated Jan. 23, 2008 (4pgs.).

* cited by examiner

*Primary Examiner*—Edgardo San Martin
(74) *Attorney, Agent, or Firm*—Howard IP Law Group, PC

(57) ABSTRACT

The invention relates to a silencer for an airborne sound conducting pipe system, including a housing enclosing an interior space, an inlet pipe having an outlet within the interior space, a bypass pipe branching off from inlet pipe within the housing and having an outlet, a control element actuated by the gas flow and arranged downstream of bypass pipe on or in the inlet pipe, and at least one outlet pipe having an inlet within the interior space. Furthermore, the interior space is acoustically unseparated in such a manner that the volume of the interior space loaded with the airborne sound is equal with opened and with closed control element.

13 Claims, 1 Drawing Sheet

SILENCER

CLAIM OF PRIORITY

This application claims foreign priority of German Patent Application No. DE 10 2007 026 811.6, filed Jun. 6, 2007 in Germany, which application is incorporated herein by reference in its entirety.

FIELD OF THE INVENTION

The present invention relates to a silencer for an airborne sound-conducting pipe system, particularly for an exhaust-gas system, preferably for an internal combustion engine.

BACKGROUND OF THE INVENTION

For pipe systems in which airborne sound can spread out, as for example in channels of ventilation systems or air conditioning systems, in inlet and outlet pipes of compressors or superchargers, in fresh-gas systems and in exhaust-gas systems of internal combustion engines, silencers are used for prevention of undesirable sound emission to the environment. For example, some silencers operate according to an absorptive design, a reflective design, or combinations thereof. Such designs result in a substantially constant absorbing effect with regards to the absorbed frequencies. However, in the case of internal combustion engines, the spectrum of disturbing sound varies heavily since it is rotation speed-dependent and load-dependent. For example, at dominating engine orders there exist considerably excessive sound pressure levels.

Furthermore, silencers may include a flap with which a gas flow path within the silencer is controllable. There are active systems known in which an external control is required for actuating an actuator driving the respective flap, and passive systems in which the respective flap is actuated by the gas flow. By use of such a flap the absorbing effect and the back pressure behaviour of the silencer can be influenced. However, active systems are comparatively intensive in regard to the manufacturing costs due to the required additional active control components, such as, for example, the control unit, vacuum actuator, vacuum pipe, and control valve. Passive systems are lower priced than active systems, but they can be configured more or less complicated and/or develop only a little acoustic effect and/or generate a comparatively high back pressure and/or have a comparatively high package volume.

SUMMARY OF THE INVENTION

The present invention provides in exemplary embodiments a silencer, which is comparatively inexpensive and/or is comparatively compact and/or has a comparatively high acoustic effect including advantageous back pressure behaviour.

The present invention is based on the general idea to branch off a bypass pipe from a silencer, the inlet pipe of which is equipped with a passive operating control element and to form and arrange, respectively, the pipe system in the housing in such a manner that the interior space of the housing, thus substantially the total silencer volume, is acoustically effective at opened and at closed control element. In case of low mass flows, as they occur at idle speed of an internal combustion engine, for example, the control element remains closed and the gas flow and the airborne sound transported therein are—with exception of some unavoidable leakage at the flaps—solely directed through the bypass pipe. Thereby, a comparatively high acoustical absorbing effect can be achieved. In case of high mass flows, as they occur at full load of an internal combustion engine, for example, the respective control element is open so that the gas flow and the airborne sound transported therein to a large extent reach the interior space of the silencer through the end portion of the inlet pipe controlled by the control element. In this case, the exhaust gas back pressure is comparatively low. The acoustical effect of the silencer for this case can be rated in a manner that it is still acceptable for the respective application of the silencer. By way of the proposed construction, the silencer has a comparatively simple and insofar universal design suitable for different applications. The silencer is in particular cost effectively manufacturable because of the unseparated interior space. The proposed silencer is further characterized by a high acoustical absorbing effect at low gas flow, as it occurs at low speeds and operating loads of an internal combustion engine. In case of high gas flows, as they occur at high speeds and operating loads of an internal combustion engine, the proposed silencer is characterized by a comparatively low flow noise and a comparatively low back pressure, which in particular is achieved by use of the acoustically unseparated interior space. Furthermore, the construction space in case of the proposed silencer is smaller than in case of conventional silencers, which have comparable acoustical properties without control elements and/or a comparable low back pressure.

According to an exemplary embodiment, the outlet of the inlet pipe, the outlet of the bypass pipe and the respective inlet of the at least one outlet pipe can acoustically be arranged within the same space or volume. Hereby can be achieved in a comparatively cost effective manner that, with opened and closed control element, the volume of the interior space loaded with the airborne sound is equal which results in the desired acoustically unseparated interior space.

According to an exemplary embodiment, the silencer can contain at least one absorption bushing which, for at least one outlet pipe, encloses an axial section extending in the interior space and is acoustically coupled with the interior of the respective outlet pipe. Additionally or alternatively, within the housing, at least one absorption chamber can be formed, which is acoustically coupled with the rest of the interior space. The respective absorption bushing and the respective absorption chamber, respectively, are arranged in a shunt thereby not affecting gas flow nor sound propagation, neither with opened nor with closed flap. They effect an intensive damping of high-frequency flow noises which, in particular, can occur when the respective control elements are being passed.

It is to be understood that the above-mentioned and the following still-to-be-described features are not only applicable in the respective indicated combination but also in other combinations or as a unique position without departing from the scope of the present invention.

Examples of embodiments of the invention are illustrated in the drawings and are discussed in the following description in more detail, wherein the same reference numbers refer to the same or similar or functionally identical components.

BRIEF DESCRIPTION OF THE DRAWINGS

In each of the figures is shown schematically.

DETAILED DESCRIPTION OF THE INVENTION

Figure 1:
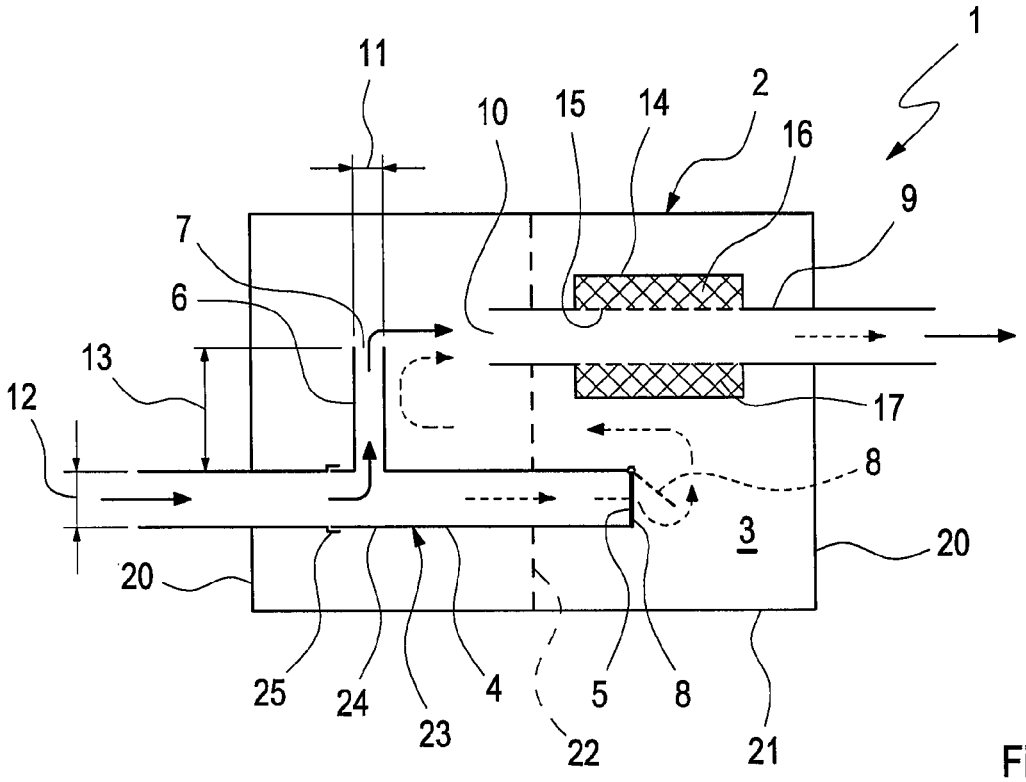
FIG. 1 shows a highly simplified diagram-like schematic illustration of a silencer in a sectional view according to an exemplary embodiment of the present invention.
Figure 2:
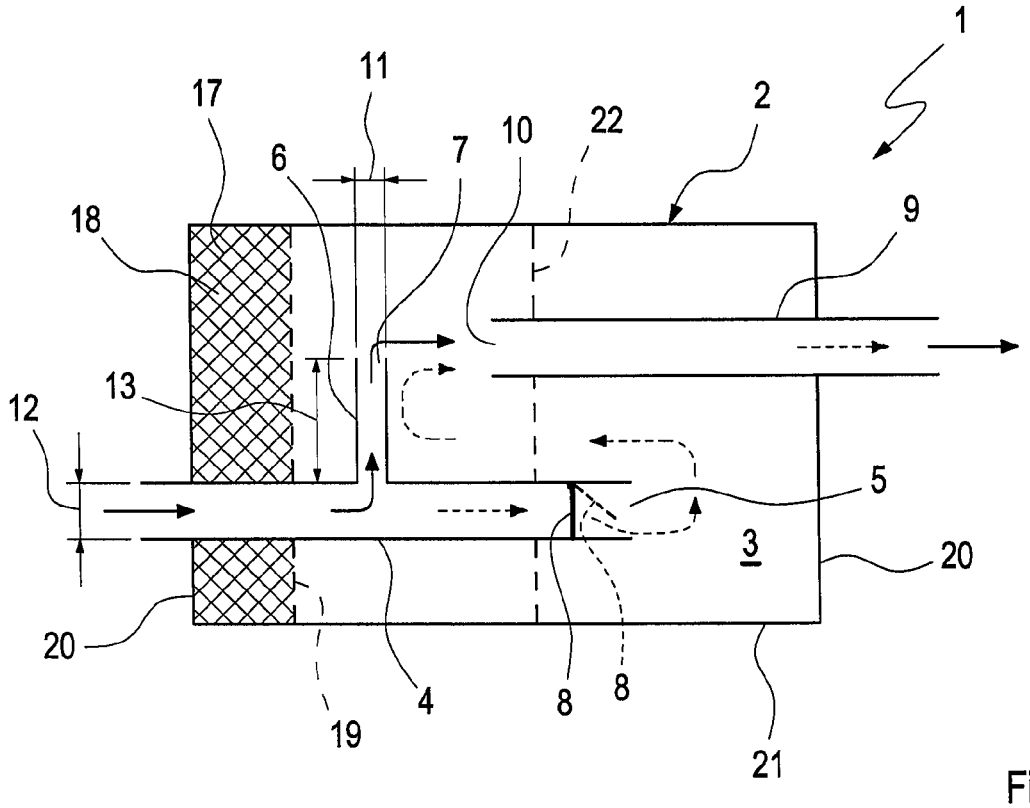
FIG. 2 shows a highly simplified diagram-like schematic illustration of a silencer in a sectional view according to another embodiment of the present invention.

According to FIGS. 1 and 2, a silencer 1 includes a housing 2 enclosing an interior space 3. The silencer 1, for example, is suited for damping of airborne sound in a pipe system that conducts airborne sound and in which airborne noise can spread out, respectively. Such pipe systems can be found, for example, with turbo groups of power stations and with internal combustion engines, namely in a fresh-gas system or in an exhaust-gas system. An exemplary use of silencer 1 is in an exhaust-gas system of an internal combustion engine, which, in particular, may be located in a vehicle.

Silencer 1 further includes an inlet pipe 4, which has at least one outlet 5, which preferably is open axially, within the interior space 3. Basically there may be provided more than one inlet pipe 4. However, illustrated here is the embodiment that has one single inlet pipe 4. From inlet pipe 4, a bypass pipe 6 branches off, namely within the housing 2 and preferably within the interior space 3. The bypass pipe 6 includes within the interior space 3, at least one outlet 7 which preferably is open axially. From the respective inlet pipe 4 or inlet pipes 4, respectively, a plurality of bypass pipes 6 may branch off. However, illustrated here is the embodiment in which only one single bypass pipe 6 is provided. In the example, the bypass pipe 6 protrudes substantially perpendicular from inlet pipe 4; other angles are possible.

On and within the inlet pipe 4, a control element 8 is arranged which is actuated in dependency of the gas mass flow. In the symbolically illustrated simplest case, the control element 8 includes a flap which is gravity-driven and/or spring-loaded into a closed position, illustrated by a solid line, and which is more or less drivable or selectively actuated for opening through the flow forces. In FIGS. 1 and 2, an open position is illustrated by a broken line. In case of a comparatively small gas flow, that is, in case of a comparatively low gas mass flow, the control element 8 remains substantially closed so that the gas flow substantially reaches the interior space 3 exclusively through the bypass pipe 6. The corresponding path guides the gas flow and hence the airborne sound transported therein and is symbolised in the figures through solid arrows. In case of a comparatively high gas flow and relatively high gas mass flows, respectively, the passive operating control element 8 opens more or less, whereby the gas flow and therefore the airborne sound more or less flows through the end portion of the inlet pipe 4 located downstream of the bypass pipe 6 and controlled by the control element 8 and therefore flows through the outlet 5 of the inlet pipe 4. Beginning with a certain amount of gas flow and beginning with a certain gas mass flow, respectively, the gas flow and hence the carried airborne sound enters for the most part through the outlet 5 of inlet pipe 4 into the interior space 3. A corresponding flow path and an airborne propagation path, respectively, are indicated by broken arrows in the figures.

The control element 8 is arranged downstream of bypass pipe 6 on or inside of the inlet pipe 4. FIG. 1 shows an embodiment in which control element 8 is arranged proximate to outlet 5 of the inlet pipe 4. In this design, the control element 8 can be particularly easily mounted to the inlet pipe 4. FIG. 2, in contrast, shows as an example an embodiment in which control element 8 is mounted into inlet pipe 4, hence located downstream of the respective outlet 5. This design, for example, can offer advantages concerning the construction space.

The silencer 1 also includes at least an outlet pipe 9, which has within the interior space 3 at least one inlet 10 which preferably is open axially. In the example, only one single outlet pipe 9 is illustrated. There are also constructions which provide more than one outlet pipe 9.

The silencer 1 is in particular characterized in that the interior space 3, in which the outlet 5 of the inlet pipe 4, the outlet 7 of the bypass pipe 6 and the inlet 10 of the outlet pipe 9 are located, is acoustically unseparated. Therefore, the mentioned openings or pipe ends 5, 7, 10 are located acoustically in the same space, namely in the interior space 3 or within the same acoustical volume, namely within the volume of the interior space 3. In the following, the volume of the interior space 3 loaded with the airborne sound is always equal, independent from the operating state of the control element 8. The airborne sound can spread out in the entire acoustical volume of the interior space 3, with both the opened and the closed control element 8. This design results in a relatively small required construction space of the silencer 1. At the same time, the construction is simplified which reduces the manufacturing costs. The bypass pipe 6 is dimensioned such that beginning with a certain predetermined gas flow a throughflow in silencer 1 arises through which the gas flow and hence the carried airborne sound reaches the interior space 3 through the outlet 5 of the inlet pipe 4. For this, for example, a cross section 11 or—in case of a circular cross section—a diameter 11 of the bypass pipe 6 is smaller than a cross section 12 and—in case of a circular cross section—a diameter 12 of the inlet pipe 4, respectively. Additionally or alternatively an axial length 13 of the bypass pipe 6 can be equal to the diameter 12 of the inlet pipe 4. In the shown examples the axial length 13 of the bypass pipe 6 is greater than the diameter 12 of the inlet pipe 4.

In the embodiment shown in FIG. 1, the inlet pipe 9 inside of the housing 2 is provided with an absorption bushing 14. The latter encloses an axial portion of the outlet pipe 9 in the interior space 3. The axial portion of the outlet pipe 9 enclosed by the absorption bushing 14 includes a perforated wall 15 thereby acoustically coupling the absorption bushing 14 and the ring space 16 thereof with the inside of the outlet pipe 9. Optionally, the ring space 16 can be filled and stuffed, respectively, with a sound absorbing material 17, particularly a porous absorption material.

Additionally or alternatively to the absorption bushing 14, the silencer 1 according to FIG. 2 may include at least one absorption chamber 18, which is arranged within the housing 2. The absorption chamber 18 which, in particular, again may be filled with a sound absorbing material 17 is limited here by a perforated wall 19 and the housing 2. In this embodiment, the absorption chamber 18 is formed in the region of the bottom 20 of housing 2 so that the respective housing bottom 20 with abutting portions of a housing shell 21 limits the respective absorption chamber 18. This or another absorption chamber may also be arranged along the (entire) housing shell 21 so that the housing shell 21 and in particular border areas of the housing bottoms 20 limit the absorption chamber. In any case, the at least one perforated wall 19 is used for limiting the absorption chamber 18 positioned in a manner that it is located between the respective absorption chamber 18 and the outlet 5 of the inlet pipe 4, the outlet 7 of the bypass pipe 6 and the inlet 10 of the outlet pipe 9. The absorption chamber 18 is therefore arranged in a shunt with no throughflow. This is valid also for the absorption bushing 14.

According to FIGS. 1 and 2, the housing 1 can be stiffened with at least one perforated intermediate floor 22. The end portions of the inlet pipe 4 and the at least one outlet pipe 9 can be supported, for example, by this intermediate floor 22.

In the exemplary embodiments of the silencer 1 of FIGS. 1 and 2, the outlet 5 of the inlet pipe 4 and the inlet 10 of the outlet pipe 9 are arranged and/or oriented relative to each other that a gas flow in the interior space 3 has to reverse its flow direction twice by about 180° to get from outlet 5 of the inlet pipe 4 to the inlet 10 of the outlet pipe 9. In contrast, the outlet 7 of the bypass pipe 6 and the inlet 10 of the outlet pipe 9 are arranged and oriented, respectively, in the interior space 3 relative to each other that the gas flow in the interior space 3 must not change its flow direction or—as here—must change only one time by 90° or less in order to get from outlet 7 of the bypass pipe 6 to the inlet 10 of the outlet pipe 9. The selected arrangements of the respective pipe ends and openings 5, 7, 10, respectively, play a part in contributing that in the respective operating state, therefore dependent from the gas mass flow, the desired effective damping and the desired comparatively low back pressure, respectively, occurs.

The embodiment of FIG. 1 shows an optionally feasible characteristic, which can be incorporated in a corresponding manner also in the embodiment shown in FIG. 2. According to FIG. 1, the silencer 1 includes for this purpose an assembly 23, which forms in regard to the other components of the silencer 1 a separate or independent pre-mounted unit. This assembly 23 includes an end portion 24 of the inlet pipe 4, which includes the bypass pipe 6 and the control element 8. This assembly 23 is formed in a manner that it can be attached comparatively simple to connecting end 25 of the remaining inlet pipe 4. Here, for example, a plug connection is possible.

It will be apparent to those skilled in the art that modifications and variations may be made in the device of the present invention without departing from the spirit or scope of the invention. It is intended that the present invention cover the modification and variations of this invention provided they come within the scope of the appended claims and their equivalents.

The invention claimed is:

1. A silencer for an airborne sound conducting pipe system, said silencer comprising:

a housing enclosing an interior space;

an inlet pipe having at least one outlet within the interior space;

a bypass pipe branching off from said inlet pipe within the housing and having at least one outlet within the interior space;

a control element arranged downstream of the bypass pipe on or in the inlet pipe and actuated by gas flow;

at least one outlet pipe having at least one inlet within the interior space, wherein the interior space is acoustically unseparated such that the volume of the interior space loaded with the airborne sound is equal with said control element opened and said control element closed.

2. The silencer according to claim 1, wherein the outlet of the inlet pipe, the outlet of the bypass pipe and the respective inlet of the at least one outlet pipe are arranged acoustically in the same space or volume.

3. The silencer according to claim 1, wherein the cross section or diameter of the bypass pipe is smaller than the cross section or diameter of the inlet pipe.

4. The silencer according to claim 1, wherein the axial length of the bypass pipe is equal to or greater than the diameter of the inlet pipe.

5. The silencer according to claim 1, wherein at least one outlet pipe within the housing has an absorption bushing.

6. The silencer according to claim 1, wherein the housing is stiffened with at least one perforated intermediate floor.

7. The silencer according to claim 1, wherein within the housing is formed at least one absorption chamber, which is limited by at least one perforated wall and by the housing, said housing comprising a housing shell or a housing bottom, and wherein the at least one perforated wall is located between the respective absorption chamber and the outlet of the inlet pipe, the outlet of the bypass pipe and the respective inlet of the at least one outlet pipe.

8. The silencer according to claim 1, wherein the outlet of the inlet pipe is arranged in regard to the respective inlet of the at least one outlet pipe such that a gas flow in the interior space reverses its flow direction twice by about 180° to progress from the outlet of the inlet pipe to the respective inlet of the at least one outlet pipe.

9. The silencer according claim 1, wherein the outlet of the bypass pipe is arranged in regard to the respective inlet of the at least one outlet pipe such that a gas flow within the interior space does not change or changes only one time its flow direction by about 90° to progress from the outlet of the bypass pipe to the respective inlet of the at least one outlet pipe.

10. The silencer according to claim 1, wherein an end portion of the inlet pipe comprising the outlet and the control element and the bypass pipe is formed as a separate pre-mountable assembly, which is attached to a corresponding connecting end of the inlet pipe.

11. The silencer according to claim 1, wherein said silencer is in an exhaust gas system of an internal gas combustion engine.

12. The silencer according to claim 1, further comprising a perforated intermediate floor stiffening the housing, said floor arranged between the outlet of the inlet pipe and the inlet of the outlet pipe.

13. The silencer according to claim 12, wherein the perforated intermediate floor is arranged between the outlet of the inlet pipe and the outlet of the bypass pipe.

* * * * *